US006055991A

United States Patent [19]

Benjoseph et al.

[11] Patent Number: 6,055,991

[45] Date of Patent: May 2, 2000

[54] CIGAR DRAW BLOCKAGE TOOL

[76] Inventors: Danny Benjoseph, 7885 NW. 62nd Way, Parkland, Fla. 33067; Joel Meisner, 207 E. 37th St., Apt. 1K, New York, N.Y. 10016; David Schmall, 8911 Escondido Way East, Boca Raton, Fla. 33433

[21] Appl. No.: 09/118,630

[22] Filed: Jul. 17, 1998

[51] Int. Cl.[7] ..... A24F 13/24; B26F 1/24

[52] U.S. Cl. ..... 131/255; 131/253; 131/254; 83/660

[58] Field of Search ..... 131/255, 252, 131/253, 254, 248, 83.1, 233; 30/111, 113; 83/931, 660; 408/62; 99/544

[56] References Cited

U.S. PATENT DOCUMENTS

| | | | |
|---|---|---|---|
| D. 245,347 | 8/1977 | Casey | D27/51 |
| D. 254,811 | 4/1980 | Katz | D27/51 |
| D. 283,451 | 4/1986 | Kolpin | D27/51 |
| D. 310,730 | 9/1990 | Sielck et al. | D27/195 |
| D. 388,532 | 12/1997 | Wander | D27/195 |
| D. 392,409 | 3/1998 | Davidoski | D27/195 |
| 1,125,598 | 1/1915 | Von Sebastiani | 131/83.1 |
| 1,490,939 | 4/1924 | Rogers | 131/233 |
| 1,748,249 | 2/1930 | Skoverski | 408/62 |
| 2,250,452 | 7/1941 | Alm | 131/255 |
| 4,148,324 | 4/1979 | Muller et al. | 131/281 |
| 4,711,254 | 12/1987 | Fleisher et al. | 131/189 |
| 4,733,674 | 3/1988 | Sielck et al. | 131/255 |
| 5,535,763 | 7/1996 | Conte | 131/255 |

FOREIGN PATENT DOCUMENTS

| | | | |
|---|---|---|---|
| 396224 | 4/1909 | France | 131/253 |

*Primary Examiner*—James Derrington
*Assistant Examiner*—Dionne A. Walls
*Attorney, Agent, or Firm*—John C. Smith

[57] ABSTRACT

A cigar draw tool that holds a cigar in alignment with a needle-like punch. The punch is pushed through the length of the longitudinal axis of the cigar to create an open air channel that increases the capacity of the cigar to draw. Multiple alignment apertures are provided to allow the punch to create multiple parallel air channels in the cigar such that the user can increase the drawing capacity as desired. In addition, the multiple alignment apertures are arranged to accommodate cigars of varying sizes such that cigars of any width can be punched in the central portion of the cigar by moving the punch to an alternate alignment aperture. A removable lid is used to hold the cigar in alignment with the punch during the punch operation. An alternate embodiment uses an automatically retracting lid that is spring loaded hold the cigar in alignment. Another alternative embodiment uses a hinged lid that flips open to allow a cigar to be inserted or removed. The hinge is slotted to allow the lid to slide such that it rests uniformly on the side of a cigar regardless of the thickness of the cigar. An alternative embodiment uses a punch that has threaded sides like an auger. Another alternative embodiment, uses a motorized drive that moves a threaded punch into and out of the cigar.

13 Claims, 20 Drawing Sheets

CIGAR DRAW BLOCKAGE TOOL

BACKGROUND OF THE INVENTION

1. Technical Field

The present invention relates to tobacco smoking devices. In particular, it relates to cigars and to a tool for opening blockages inside a cigar to allow proper drawing of the cigar.

2. Background Art

The tobacco industry provides a number of products. Some products, like cigarettes and pipes, use relatively finely and or uniformly ground tobacco. When tobacco is cut in this manner, the tobacco provides a relatively consistent draw which allows each cigarette or pipe to draw in the same manner for each smoke.

Cigars, on the other hand, are manufactured in a variety of ways. They may be made by machine, or in the case of more expensive brands, they may also be made by hand. The size and shape of the pieces of tobacco in a cigar will also vary. It is this variation in the tobacco filler used to manufacture cigars that causes irregularities in drawing performance and even cause failure of the cigar to draw at all. Cigars that draw poorly or do not draw at all are often discarded by the smoker, or returned to the manufacturer for a refund. Since cigars may be relatively expensive, the problems caused by drawing failure will create either an unnecessary expense to the smoker, or lost profits to the manufacturer who accepts return of the defective cigars.

The drawing problems are usually caused by the tobacco fill material. Sometimes the tobacco fragments in the fill material in a cigar can be substantially large. They may block a portion of the air passage through which smoke passes, and may even block the air passage entirely if the fragment is large enough. When this happens, the cigar is unusable or usable only with difficulty.

This undesired side effect of the manufacturing techniques used to manufacture cigars, namely the unevenness of drawing smoke through the cigar, results in a situation where the same box of cigars may contain several cigars that draw in an easy and desirable fashion, some that draw with some difficulty, and some that may not draw at all. This leads to a situation where the smoker may be inconvenienced and the manufacturer may lose future sales or incur losses due to returns. It would be desirable to provide a method of increasing the drawing capability of a cigar, when necessary, such that heretofore unusable cigars could be enjoyed by a smoker.

An associated manufacturing problem is the reduction in drawing capability of a cigar due to the filler tobacco in the cigar being too tightly packed during the bunching or manufacturing process. In this situation, there may not be any overly large fragments of tobacco fill, but the limited open space due to the tight packing is such that airflow through the cigar is restricted. Smokers will have the same difficulty in drawing smoke through a tightly packed cigar as they had in the foregoing situation where the tobacco fragments acted as barriers. Another possible draw restriction could be due to overly moist tobaccao which is caused storing the tobacco in improper humidity. In like fashion, it would be desirable to provide a method of increasing the drawing capability of a tightly packed cigar, or a cigar with overly moist tobacco, when necessary, such that the heretofore unusable cigar could be enjoyed by a smoker.

In the past, the smoker's only recourse was to either throw away the cigar entirely, or to cut off segments of the cigar until a portion that was usable was reached. This may result in only a small portion of the cigar that is available for use. Further, if more than one blockage exists in the cigar, then cutting off segments of the cigar may not effect the drawing capability of the cigar. As a result, a smoker has limited recourse when trying to smoke a poorly drawing cigar.

The prior art has failed to provide a tool which is inexpensive to manufacture, has a minimum number of parts, is easy to use, and which effectively creates an air passage through the cigar to allow adequate drawing capability.

SUMMARY OF THE INVENTION

The present invention solves the foregoing problems by providing a tool that holds a cigar in alignment with a needle-like punch. The punch is pushed through the length of the longitudinal axis of the cigar to create an open air channel that increases the drawing capacity of the cigar. A number of alignment apertures are provided to allow the punch to create multiple parallel air channels in the cigar such that the user can increase the drawing capacity as desired. In addition, multiple alignment apertures are arranged to accommodate cigars of varying sizes such that cigars of any width can be punched in the central portion of the cigar by moving the punch to an alternate alignment aperture. A removable lid is used to hold the cigar in alignment with the punch during the punch operation. An alternate embodiment uses an automatically retracting lid that is spring loaded and holds the cigar in alignment. Another alternative embodiment uses a hinged lid that flips open to allow a cigar to be inserted or removed. The hinge is slotted to allow the lid to slide such that it rests uniformly on the side of a cigar regardless of the thickness of the cigar. An alternative embodiment uses a punch that have threaded sides like an auger. Another alternative embodiment, uses a motorized drive that moves a threaded punch into and out of the cigar.

DESCRIPTION OF THE PREFERRED EMBODIMENT

Prior to a detailed discussion of the figures, a general discussion of the features and advantages of the invention will be presented. As discussed above, cigar smokers often are inconvenienced by the inability of a cigar to draw. This is often caused by a blockage inside the cigar by a large fragment of fill tobacco, or by the cigar being too tightly packed. Many cigars are discarded for this reason. Unfortunately, since cigars can be relatively expensive, this results in a waste of the smoker's money, or a loss of profit to the manufacturer if the cigars are returned.

A portion of some of these non-drawing cigars cain be salvaged. This is accomplished by progressively cutting off portions of the cigar until a segment is reached that adequately draws. Depending on the location of the fill fragment that is preventing the cigar from drawing, this may result in only a small portion of the cigar being usable. In the case of tightly wound cigars, cutting off segments of the cigar may have no effect.

The invention eliminates drawing problems by opening an air passage through the length of the cigar such that the entire cigar is usable. To accomplish this, a cigar cradle is provided that has punch alignment holes in the proximal end. The punch is inserted into the punch alignment holes and penetrates the proximal end of the cigar. The cradle holds the cigar in alignment with the punch such that the punch pushes through the longitudinal length of the cigar without damaging the outer wall of the cigar. This results in an inner air passage that opens any blockages created by large tobacco fill fragments. It also opens passages in cigars that have been too tightly packed. The air passages allow smoke to be drawn through the cigar. As a result, a cigar that may have previously been unusable can be enjoyed by a smoker.

The invention uses multiple punch alignment apertures. This allows a smoker to select the punch alignment aperture that best suits the particular thickness of the cigar. In addition, the multiple punch alignment apertures allow a smoker to create extra parallel air passages to increase the total drawing capacity of the cigar as desired.

Several optional preferred embodiments are provided. One embodiment uses a removable lid that holds the cigar in place. Another embodiment uses a retractable spring loaded lid to hold the cigar. A third embodiment uses a hinged lid which is slotted to allow the lid to adjust to any cigar width. Turning now to a discussion of the figures, a more detailed discussion of the invention follows.

Figure 1:
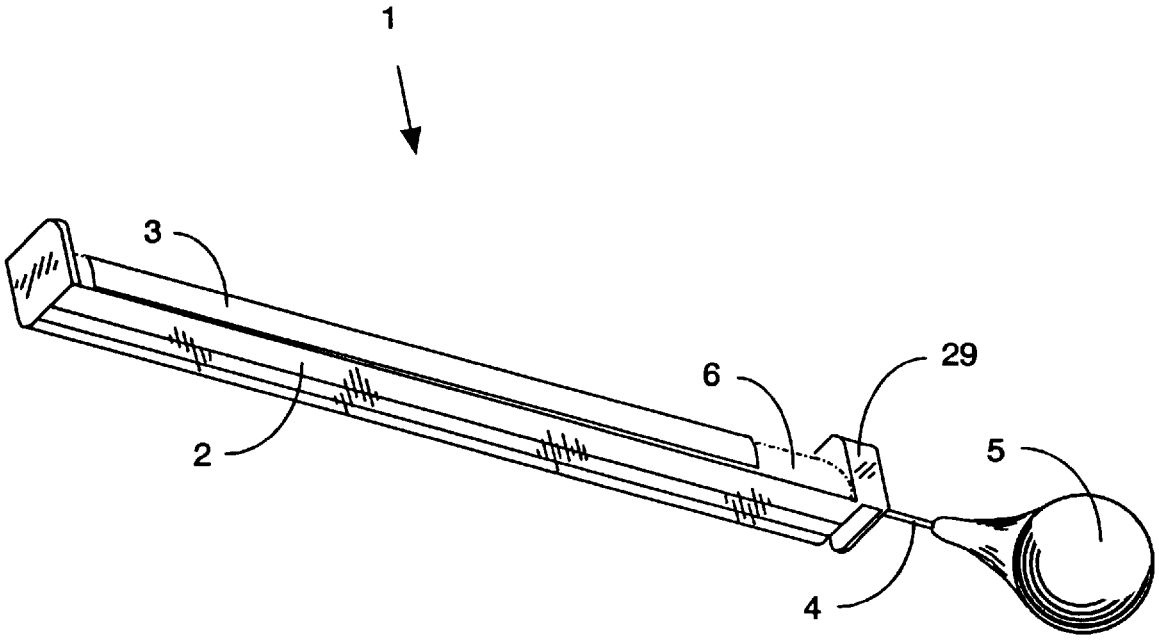
FIG. 1 is a perspective view of a preferred embodiment of the drawing device.

Referring to FIG. 1, this figure shows a perspective view of a preferred embodiment of the draw blockage tool 1. In this embodiment, a cigar 6 (shown in dashed lines) rests in a cigar cradle 2. In practice, a smoker would use a finger (not shown) to hold the removable lid 3 in place against the cigar 6.

The proximal end 29 of the cigar cradle 2 has alignment holes 11, 12 (shown in FIG. 3). A punch 4, which is needle-like in shape, is inserted in the alignment holes 11, 12 which are aligned with the longitudinal axis of the cigar 6. The alignment apertures are set in alignment with the longitudinal axis of the cigar 6 to prevent the punch 4 from penetrating the side wrapping of the cigar 6. The smoker grasps the handle 5 of punch 4 and pushes the punch 4 through the length of cigar 6. The punch 4 opens holes in any tobacco fill fragments 15–19 (shown in FIG. 10) that are blocking the flow of smoke inside the cigar. When the punch 4 is withdrawn, the cigar 6 has an air passage that allows smoke to be drawn through the cigar 6, making it usable. While the punch 4 should preferably have a close longitudinal alignment with the cigar 6, it does not have to be exact. So long as the punch 4 creates a longitudinal air passage through the cigar 6, and does not penetrate the side wall of the cigar 6, it will achieve its purpose.

An advantage of the invention is that it opens an air passage through the entire length of the cigar 6. As a result the entire cigar 6 becomes usable.

Figure 2:
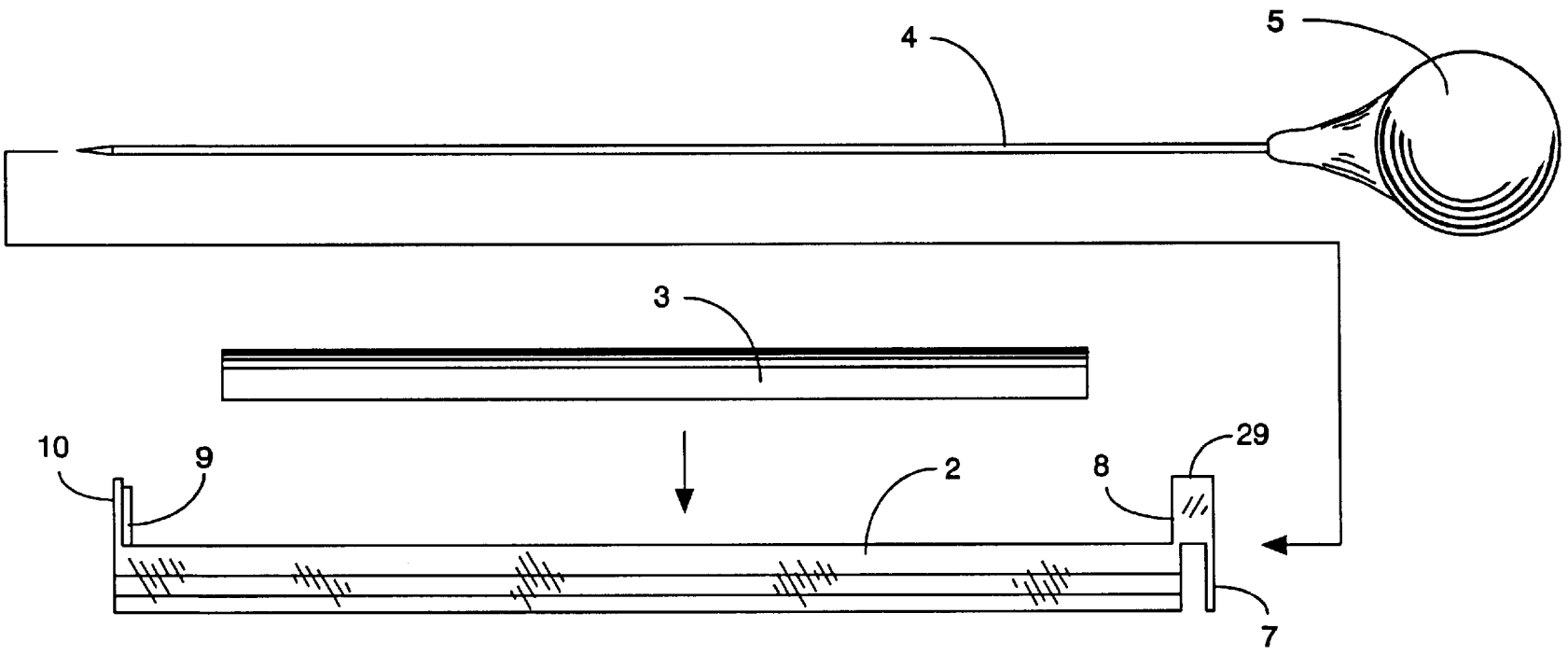
FIG. 2 is an exploded side view of the drawing device showing the cigar cradle, the lid, and the punch.

In FIG. 2, an exploded side view of the draw blockage tool 1 is shown. In this figure, the distal end of cigar cradle 2 has an end wall 10 and an optional pliant cushion 9. The optional pliant cushion 9 can be made from any suitable material such as cork, rubber, plastic, polyethylene, polypropylene, etc. The preferred embodiment uses cork. The end wall 10 prevents the cigar 6 from slipping when the punch 4 is being pushed through it to create an air passage.

In the preferred embodiment, the proximal end 29 uses an outer wall 7 and an inner wall 8. By using separate outer and inner walls 7, 8, each with corresponding alignment holes, the punch 4 can be properly aligned. In addition, by using separate outer and inner walls 7, 8 instead of a single solid end wall, the weight of the draw blockage tool 1 is reduced.

Lid 3 is also shown. In this embodiment, lid 3 is removable. After a cigar is placed in cigar cradle 2, the lid 3 is laid on top of the cigar 6 to hold it in place. Those skilled in the art will recognize that the draw blockage tool 1 can be used without lid 3, by merely holding the cigar 6 in place with the user's finger. However, the lid 3 allows the force used to hold the cigar 6 in place to be distributed over a wide area of cigar 6, thereby avoiding any damage that pressure on a small area may cause.

Punch 4 and handle 5 are also shown. As can be seen, the punch 4 is long enough to travel the entire longitudinal length of cigar cradle 2. Therefore, when a cigar 6 is placed in cigar cradle 2, the punch 4 can penetrate any large tobacco fill framents 15–19. While cigar 6 lengths will vary by brand, the preferred embodiment of cigar cradle 2 uses an internal longitudinal length of approximately seven and one half inches, which is enough to accommodate most cigar 6 lengths. Of course, the cigar cradle 6 can be fabricated at any desired length.

Figure 3A:
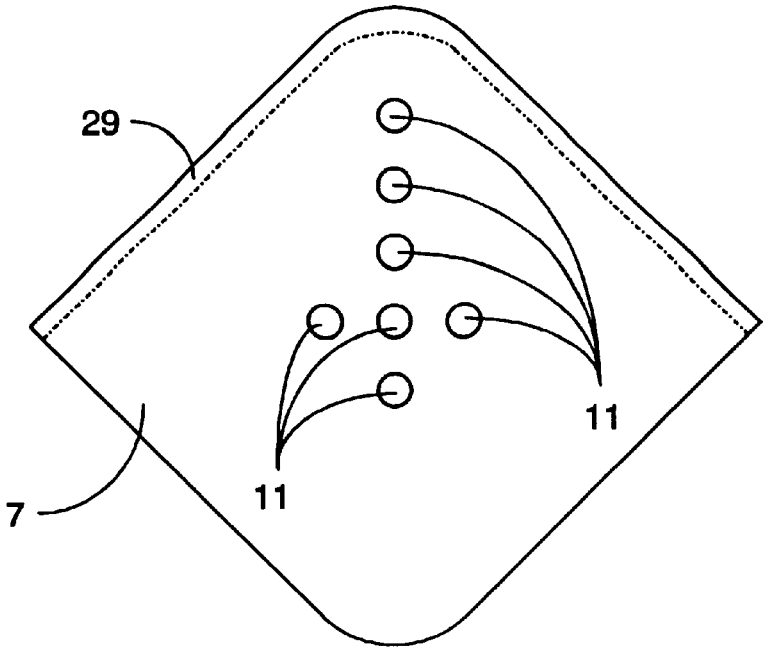
FIG. 3A is an outside end view of the proximal end of the cigar cradle showing the alignment apertures.

FIG. 3A is an end view of the outer wall 7 of the proximal end 29 of the cigar cradle 2 showing the alignment apertures 11 in outer wall 7. A portion of the alignment apertures 11 are arranged along a vertical axis which allows a central air passage to be punched through cigars 6 having a variety of thicknesses. The smoker merely selects the alignment aperture that corresponds with the central longitudinal axis of the cigar 6. Additional alignment apertures 11 are also provided that are not on the forgoing vertical axis. This allows the smoker the option of increasing the drawing capacity of the cigar 6 by punching multiple parallel air passages in the same cigar 6. As a result the smoker can increase the drawing capacity gradually if the initial air passage is not sufficient to create the desired draw.

Figure 3B:
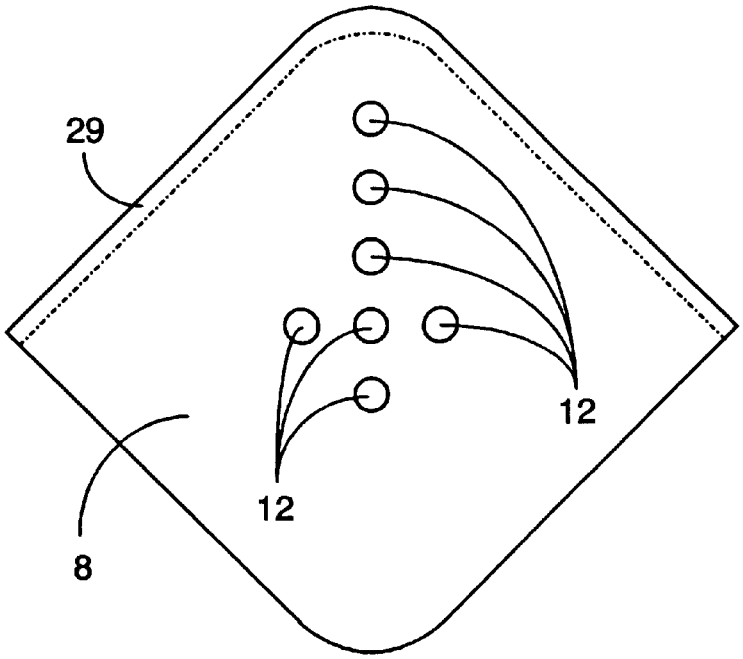
FIG. 3B is an inside end view of the proximal end of the cigar cradle showing the alignment apertures.

FIG. 3B is an inside end view of the inner wall 8 of the cigar cradle showing the alignment apertures 12. Alignment apertures 11 and 12 are aligned with each other such that when the punch 4 is inserted in an alignment aperture 11 on the outer wall 7, it will pass through a corresponding alignment hole 12 on the inner wall 8. Alignment apertures 11 and 12 will act to guide punch 4 along a straight path that travels through a longitudinal plane of cigar 6.

Figure 4A:
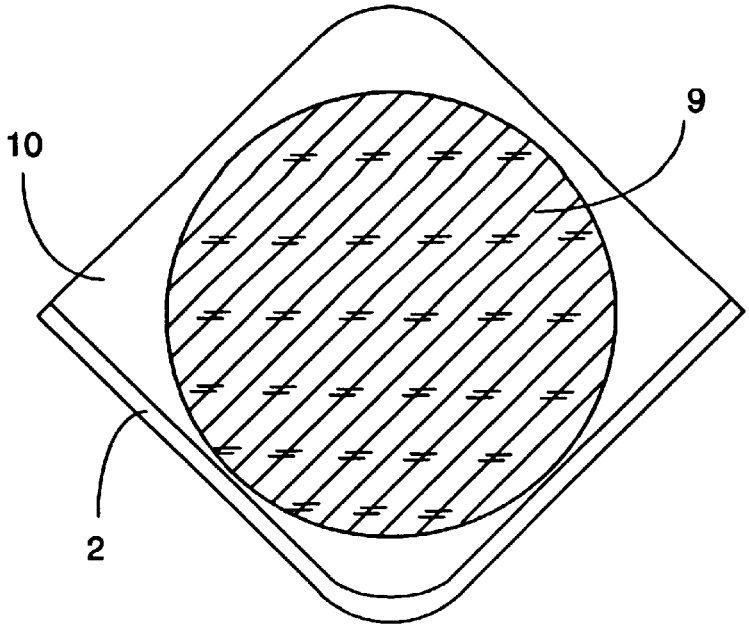
FIG. 4A is an inside end view of the distal end of the cigar cradle. An optional pliant cushion is shown in this figure.

FIG. 4A is an inside end view of the distal end wall 10 of the cigar cradle 2. An optional pliant cushion 9 is shown in this figure. In the preferred embodiment, pliant cushion 9 is fabricated from cork, but it can be any suitable material. When the punch 4 is pushing through a cigar 6, the distal end of cigar 6 rests against the pliant cushion 9.

Figure 4B:
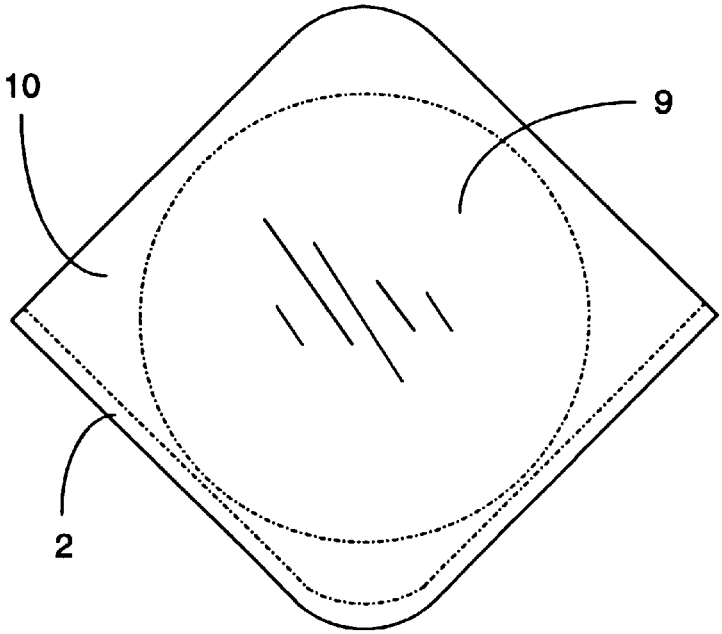
FIG. 4B is an outside end view of the distal end of the cigar cradle.

FIG. 4B is an outside end view of the distal end wall 10 of the cigar cradle 2. The location of the pliant cushion 9 and the side wall of cigar cradle 2 are shown in dashed lines to indicate their position on the opposite side of distal end wall 10.

Figure 5:
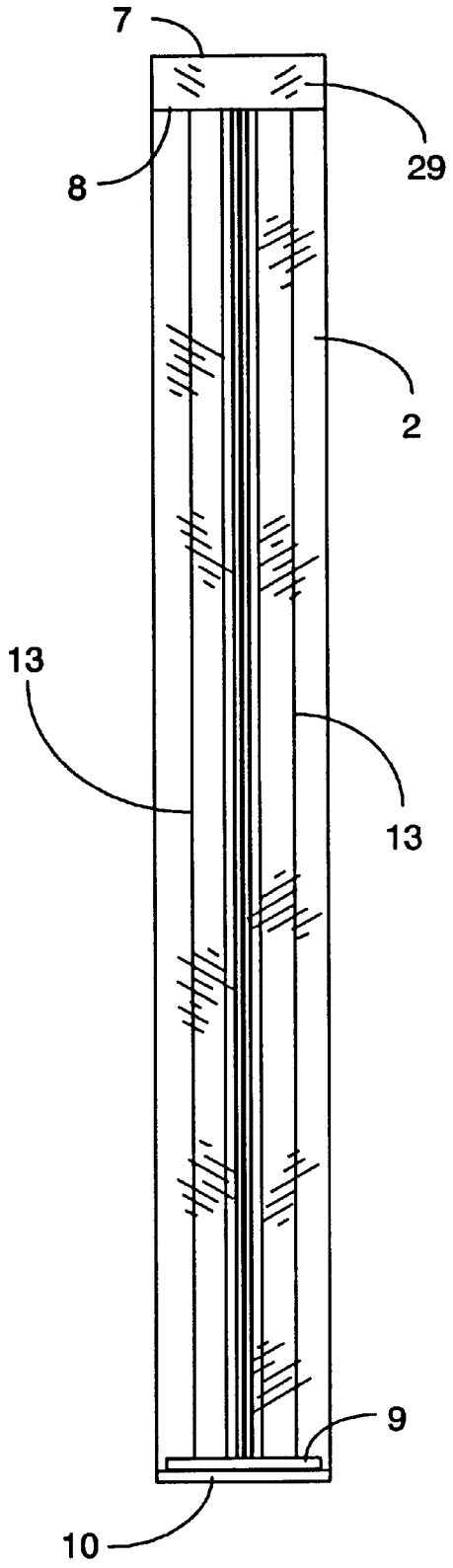
FIG. 5 is a top view of the cigar cradle.

FIG. 5 is a top plan view of the cigar cradle 2. The proximal end 29 is bordered by outer wall 7 and inner wall 8. Distal end wall 10 is shown at the opposite end of cigar cradle 2 along with optional cushion 9. Optional grooves 13 are also shown. Optional grooves 13 are located such that the edges of lid 3 can be seated in grooves 13. Grooves 13 allow the lid 3 to be more securely held in place for storage by securing the lid 3 to the cigar cradle 2 via rubber bands, hook and loop strips, etc.

Figure 6:
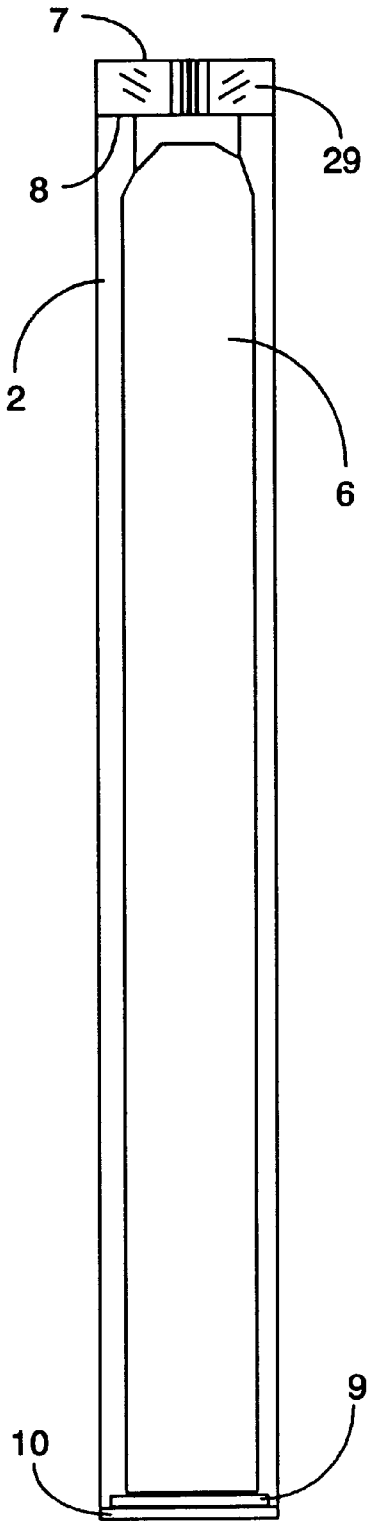
FIG. 6 is a top view of the cigar cradle with a cigar resting in the cigar cradle.

FIG. 6 is a top view of the cigar cradle 2 with a cigar 6 resting in the cigar cradle 2. The cigar 6 is shown with its distal end resting against optional pliant cushion 9.

Figure 7:
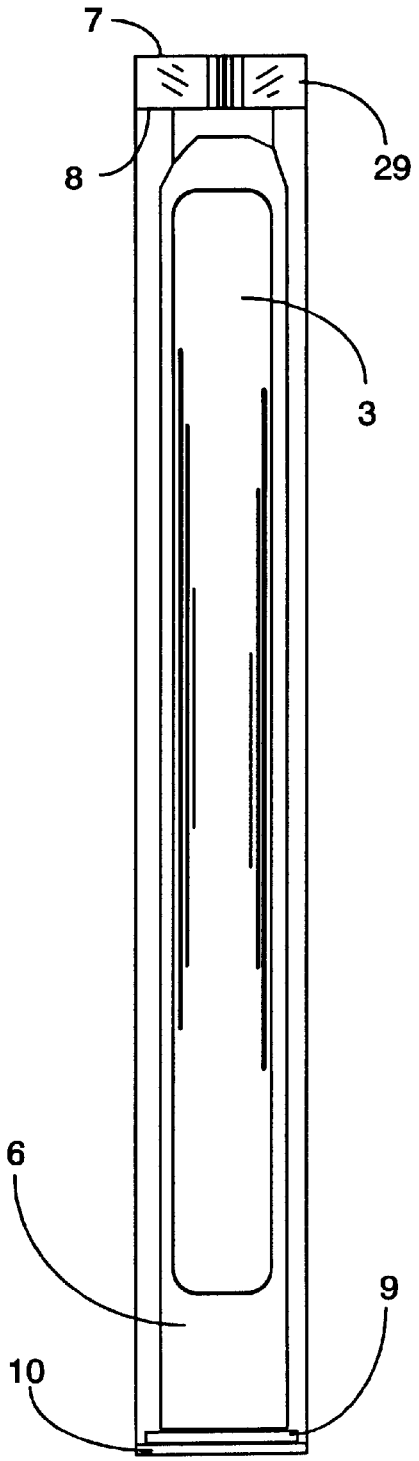
FIG. 7 is a top view of the cigar cradle with a cigar resting in the cigar cradle, and the removable lid resting on top of the cigar and holding it in alignment with the alignment apertures.

FIG. 7 is a top view of the cigar cradle 2 with a cigar 6 resting in the cigar cradle 2, and the removable lid 3 resting on top of the cigar 6 and holding it in alignment with the alignment apertures. As can be seen, an advantage of removable lid 3 is that it allows a smoker to exert pressure on the cigar 6 to hold it in place without exerting force on a small area of cigar 6. The lid 3 distributed the force across a wide area of the cigar 6, thereby avoiding any damage that the smoker's finger might cause in the absence of lid 3.

Figure 8:
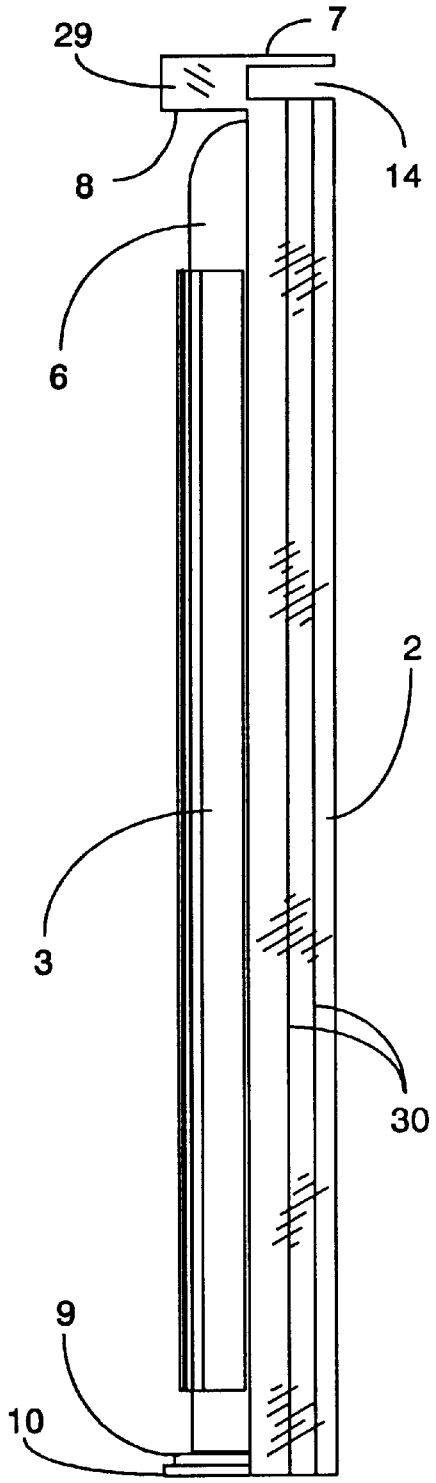
FIG. 8 is a side view of the cigar cradle with a cigar resting in the cigar cradle, and the removable lid resting on top of the cigar and holding it in alignment with the alignment apertures.

FIG. 8 is a side view of the cigar cradle 2 with a cigar 6 resting in the cigar cradle 2, and the removable lid 3 resting on top of the cigar 6 and holding it in alignment with the alignment apertures 11, 12.

Figure 9A:
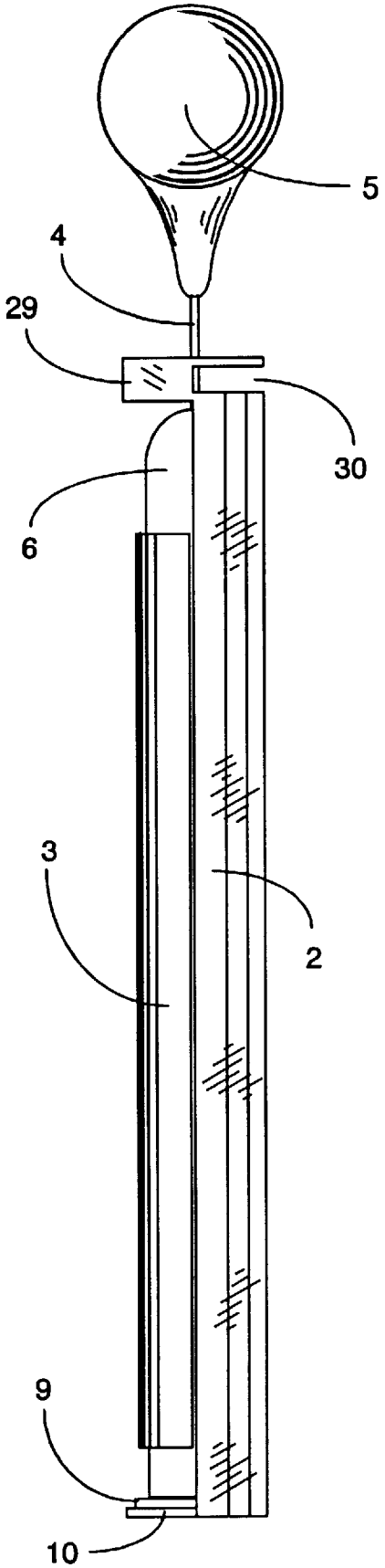
FIG. 9A is a side view of the cigar cradle with a cigar resting in the cigar cradle, the removable lid resting on top of the cigar and holding it in alignment with the alignment apertures, and the punch inserted through the alignment apertures and the cigar.

FIG. 9A is a side view of the cigar cradle 2 with a cigar 6 resting in the cigar cradle 2, the removable lid 3 resting on top of the cigar 6 and holding it in alignment with the alignment apertures, and the punch 4 inserted through the alignment apertures and the cigar 6 along a longitudinal axis of the cigar 6. In the preferred embodiment, an opening 30 is left between the inner wall 8 and the outer wall 7 of the cigar cradle 2. This allows any debris to be more easily removed.

Figure 9B:
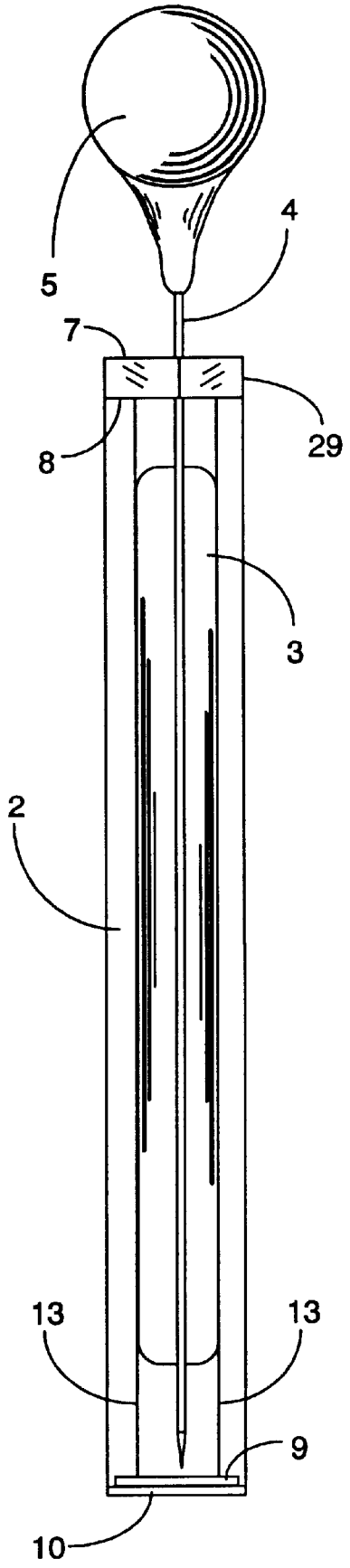
FIG. 9B is a top view of the cigar cradle with the removable lid held in place by the punch when the device is in the storage position.

In FIG. 9B, the device is shown in the storage configuration wherein the punch 4 is used to securely hold the lid 3 in place when the device is not being used. This figure shows a top view of the cigar cradle 2 with the removable lid 3 resting on top of the cigar cradle 2. The edges of the lid 3 rest in the grooves 13. One pair of alignment apertures 11, 12 are aligned such that the punch 4, when inserted through the alignment apertures 11, 12, rests against the top surface of lid 3 and holds lid 3 securely in place for ease of storage. In an alternative preferred embodiment, a longitudinal lid groove is formed in the upper surface of the lid 3 which is used to secure the lid 3 to the cradle 2 when it is being stored. This is accomplished as follows: the lid 3 is installed such that its edges fit within the grooves 13 of the cradle 2. In this position, one pair of the apertures 11, 12 are also aligned with the longitudinal groove such that when the punch 4 is inserted through the apertures 11, 12, it rests in the longitudinal lid groove and prevents the lid 3 from becoming disengaged from the cradle 2.

Figure 10:
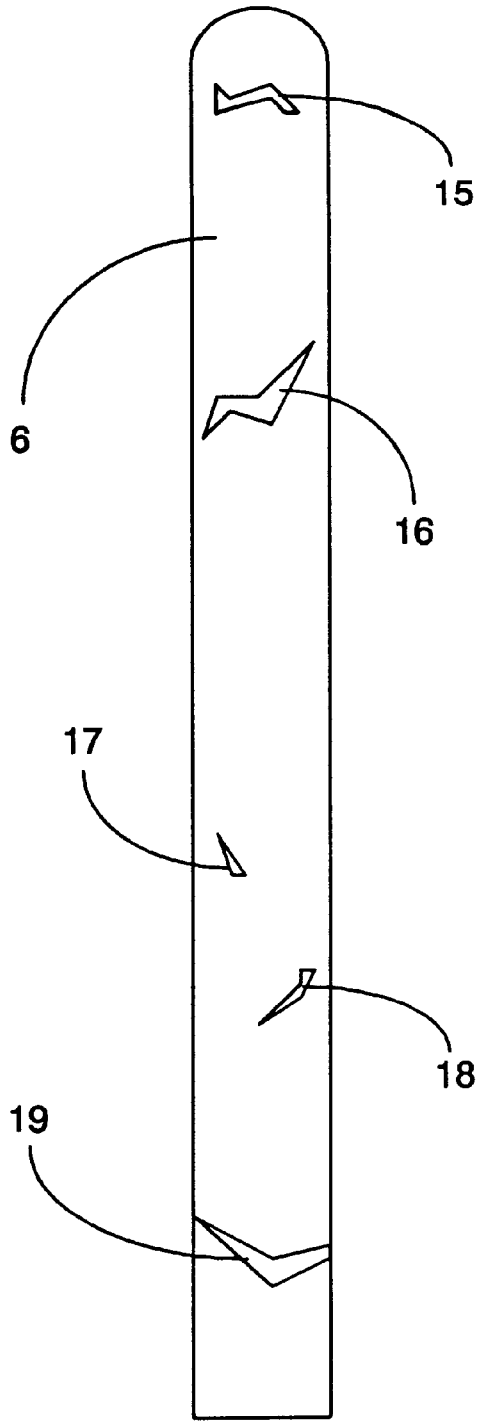
FIG. 10 is a cutaway view of a cigar illustrating multiple blockages in the cigar created by large fill fragments.

FIG. 10 is a cutaway view of a cigar 6 illustrating multiple blockages in the cigar 6 created by large tobacco fill fragments 15–19. As can be seen, some fragments, such as tobacco fill fragments 17–18 can be relatively small, resulting in some blockage of air flow and drawing capacity. Other fragments, such as tobacco fill fragments 15–16 can be larger, resulting in substantial blockages of air flow and drawing capacity. While still other fragments, such as tobacco fill fragment 19 can be large enough to substantially block all air flow and drawing capacity.

Figure 11:
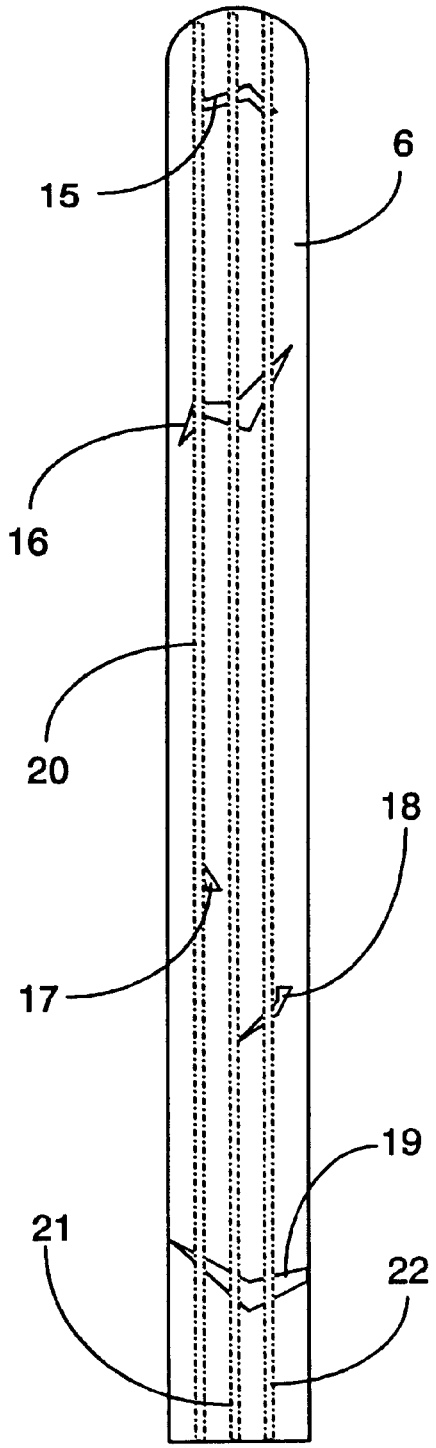
FIG. 11 is a cutaway view of a cigar illustrating air passages created in the cigar by the punch which penetrate the multiple blockages in the cigar created by large fill fragments.

FIG. 11 is a cutaway view of a cigar 6 illustrating air passages 20, 21, 22 created in the cigar 6 by the punch 4 which penetrates the multiple blockages in the cigar 6 created by tobacco fill fragments 15–19. As can be seen in this figure, one advantage of having multiple punch alignment apertures 11, 12 is that the tobacco fill fragments 15–19 may or may not be located in the central longitudinal axis of the cigar 6. For example, tobacco fill fragments 17–18 may cause sufficient reduction draw to reduce the enjoyment of the cigar for a smoker. However, if the punch 4 only created a central air passage 21, neither of the smaller tobacco fill fragments 17–18 would have been penetrated. By having multiple punch alignment apertures 11, 12, the smoker can create multiple air passages. In this case, an air passage 20 would have penetrated tobacco fill fragment 17 and an air passage 22 would have penetrated tobacco fill fragment 18.

In the case where a tobacco fill fragment was large enough to block all air flow and drawing capacity, such as tobacco fill fragment 19, a single air passage may create inadequate draw. By using multiple punch alignment apertures 11, 12, multiple air passages 20–22 can be opened in tobacco fill fragment 19 which would in turn allow what would otherwise be an unusable cigar 6 to be used.

The foregoing embodiment provides an easy to use method of opening air passages 20–22 through the entire length of a cigar 6. As a result, a cigar 6 that might have been heretofore unsmokable may now be enjoyed by the smoker. This allows the smoker to avoid inconvenience as well as the expense involved with defective cigars.

In the preferred embodiment, moldable materials (such as plastic, etc.) are used to facilitate ease of manufacture. Likewise, the preferred embodiment uses stainless steel for the punch 4 and moldable material for the handle 5. However, those skilled in the art will recognize that the cigar cradle 2, the lid 3, and the punch 4 and handle 5 can be made from any suitable materials, such as plastics, wood, metal, bone, ivory, resins, meerschaum, stone, etc., depending on desired aesthetics. The thickness of the materials used to fabricate the draw blockage tool 1 can also vary. For example, the relative strengths of materials, such as stainless steel, silver, wood, plastic, or meerschaum, will dictate different thicknesses for durability purposes.

The size of the cigar draw blockage tool 1 can also vary. However, it preferably should be long enough to accommodate substantially all cigar 6 sizes. In the event an unusually long cigar 6 is blocked by a tobacco fill fragment, a small portion of the end can be cut to allow it to fit in the cigar cradle 2. Since the device uses an open cradle structure, any width cigar 6 can be held. Those skilled in the art will recognize that distal end wall 10 can be eliminated, thereby allowing the cigar draw blockage tool 1 to accommodate any length cigar 6. Of course, the cigar 6 will then have to be retained in place solely by pressure from lid 3.

Figure 12:
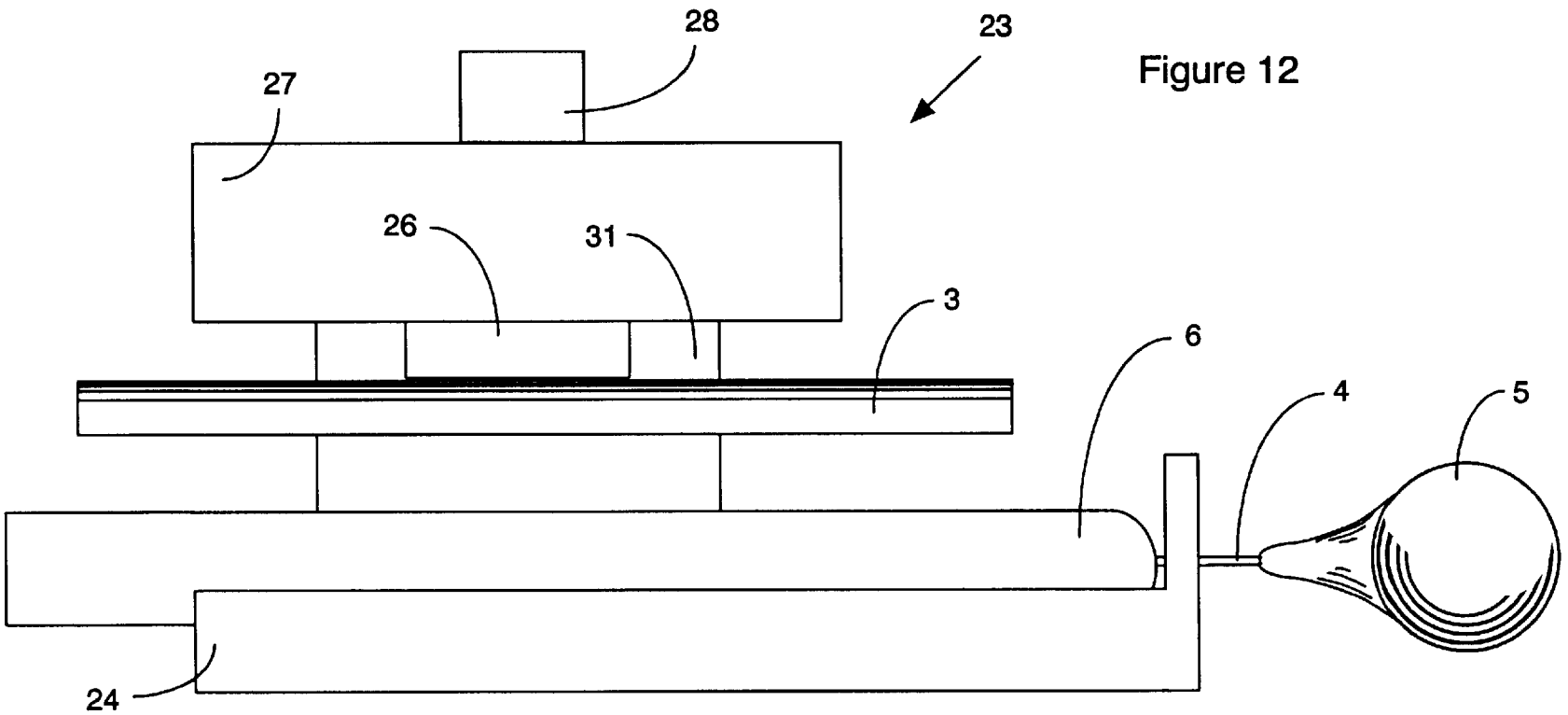
FIG. 12 is a side view of an alternative embodiment that uses a spring loaded, automatically retracting lid.

FIG. 12 is a side view of an alternative embodiment that uses a spring loaded, automatically retracting lid 3. In this embodiment, a punch 4 with a handle 5 is inserted through alignment apertures in the same manner as was done in the previous embodiment. Likewise, a cigar 6 rests on a cigar cradle 24 in the same manner as before. However, in this embodiment, the distal end wall 10 used in the previous embodiment is not present As mentioned above, this eliminates any restriction on the length of cigar 6.

Cigar cradle 24 is attached to bracket 31 which is further attached to spring assembly 27. The lid 3 is attached to slide arm 26 that is in turn attached to push button 28. Slide arm 26 is biased by spring assembly 27 such that lid 3 is retracted away from cigar 6 when in the rest position. When a smoker pushes push button 28, the lid 3 is compressed against the cigar 6 holding it in place. The punch 4 can then be used to open air passages as discussed above.

Figure 13:
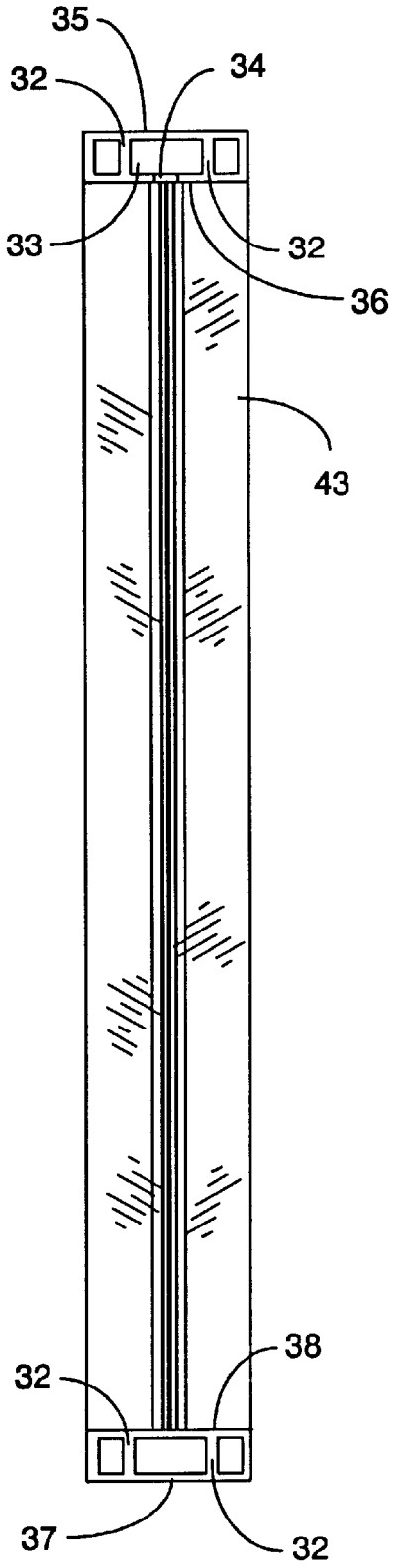
FIG. 13 is a top view of an alternative embodiment that uses a hinged lid.

FIG. 13 is a top view of another alternative embodiment. In this embodiment, the hinged cigar cradle 43 uses a hinged lid 42 (shown in FIGS. 16–18). The proximal end of the hinged cigar cradle 43 has an outer wall 37 and an inner wall 38. Ribs 32 are provided for structural support. Punch alignment apertures 11, 12 (shown in FIGS. 14A–B) are located in the inner and outer walls 37, 38 in the same manner as the embodiment of FIG. 1.

The distal end of hinged cigar cradle 43 has an inner distal wall 36 and an outer distal wall 35. Supporting ribs 32 connect inner and outer walls 35, 36 and add structural support. Hinge aperture 33 provides space for insertion of the hinge pin 41 (shown in FIG. 16). Slot 34 is sized to accommodate hinge arm 40.

Figure 14A:
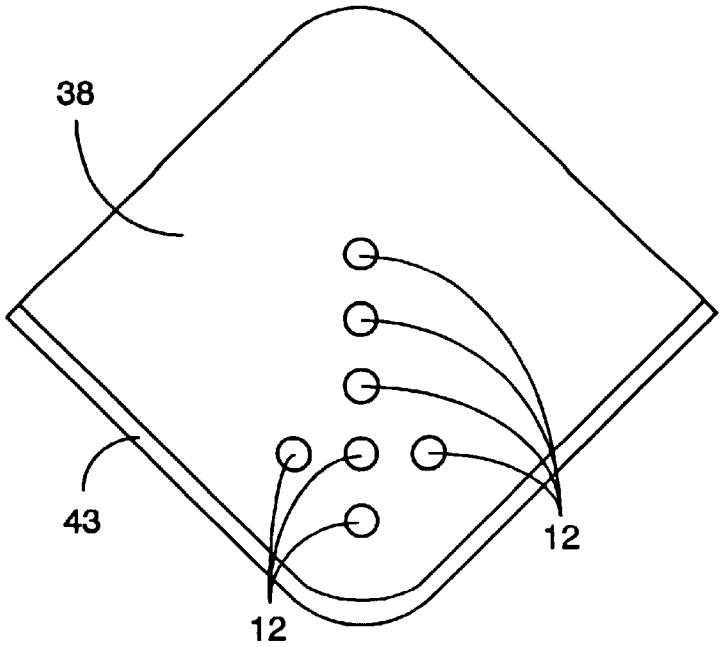
FIG. 14A is an inside end view of the proximal end of the cigar cradle of the embodiment of FIG. 13 that shows the alignment apertures.

FIG. 14A is an inside end view of the proximal inner wall 38 of the hinged cigar cradle 43 of the embodiment of FIG. 13 that shows the alignment apertures 12.

Figure 14B:
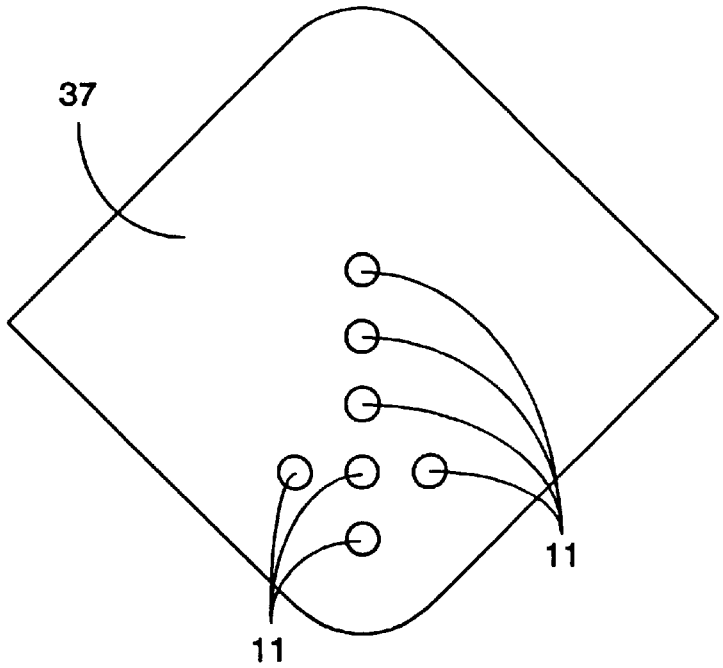
FIG. 14B is an outside end view of the proximal end of the cigar cradle of the embodiment of FIG. 13 that shows the alignment apertures.

FIG. 14B is an outside end view of the proximal outer wall 37 of the hinged cigar cradle 43 of the embodiment of FIG. 13 that shows the alignment apertures 11.

Figure 15A:
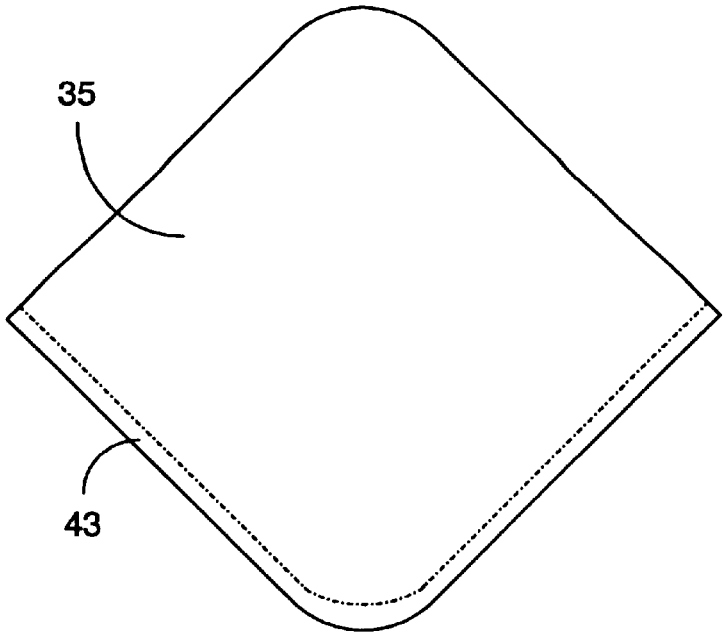
FIG. 15A is an outside end view of the embodiment of FIG. 13 that illustrates the outside distal end of the cigar cradle.

FIG. 15A is an outside end view of the embodiment of FIG. 13 that illustrates the outside distal end wall 35 of the hinged cigar cradle 43.

Figure 15B:
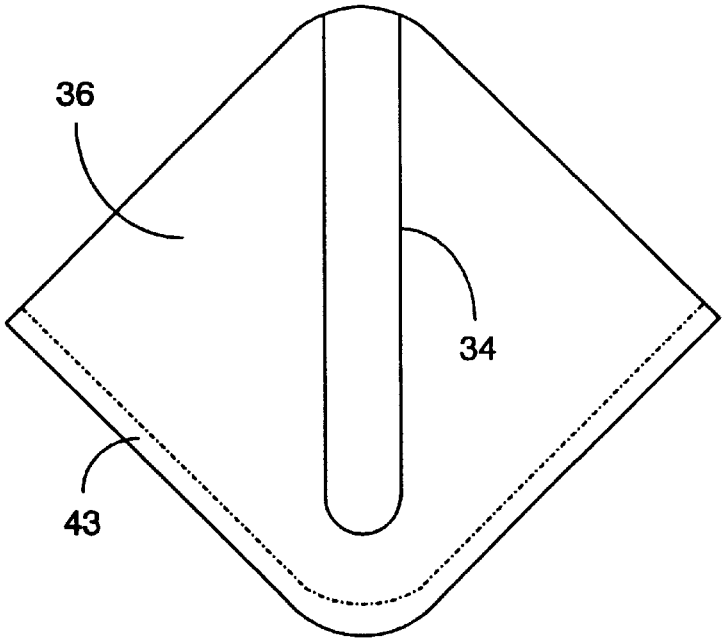
FIG. 15B is an inside end view of the embodiment of FIG. 13 that illustrates the inside distal end of the cigar cradle showing the lid slot.

FIG. 15B is an inside end view of the embodiment of FIG. 13 that illustrates the inside distal end wall 36 of the hinged cigar cradle 43 showing the lid slot 34. The lid slot 34 allows the lid 42 to raise or lower, when used, to fit the diameter of a particular cigar 6.

Figure 16:
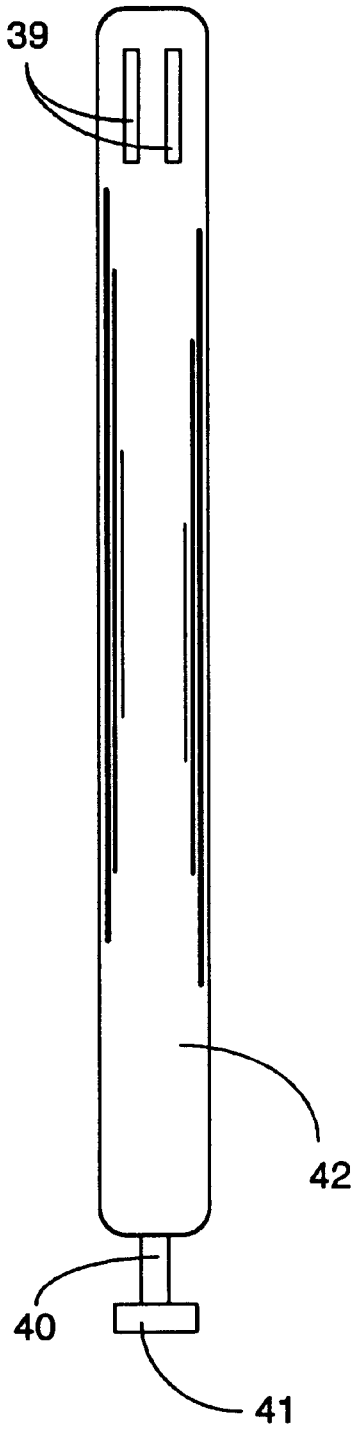
FIGS. 16 is a top plan view of the hinged lid used in the embodiment of FIG. 13. This view shows the handle and the hinge.

FIGS. 16 is a top plan view of the hinged lid 42 used in the embodiment of FIG. 13. This view shows the handles 39, the hinge arm 40 and the hinge pin 41. The hinge pin 41 is sized to slidably fit within hinge aperture 33. The hinge arm 40 slides in lid slot 34.

Figure 17:
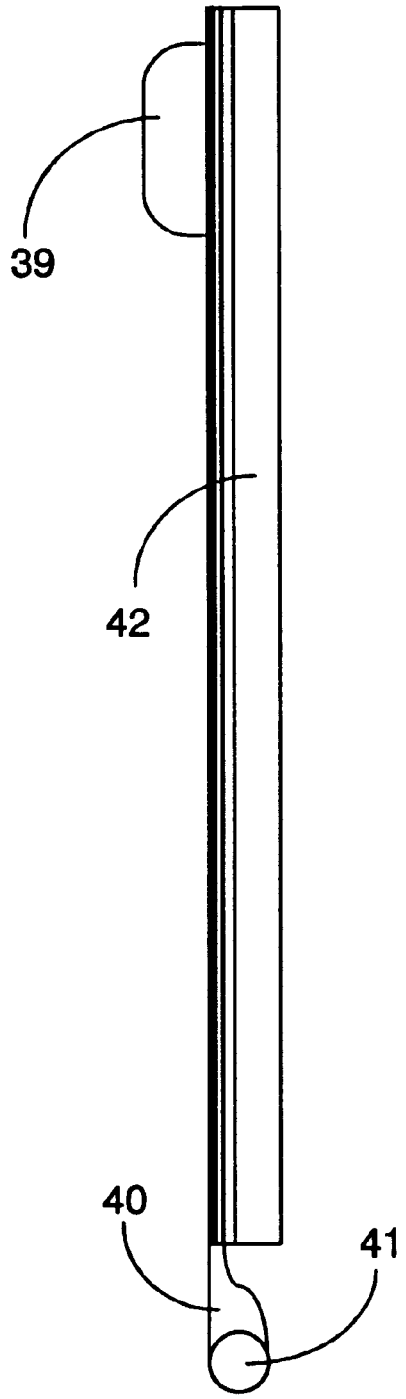
FIG. 17 is a side view of the hinged lid used in the embodiment of FIG. 13. This view shows the handle and the hinge.

FIG. 17 is a side view of the hinged lid 42 used in the embodiment of FIG. 13. This view shows the preferred location of the handles 39, the hinge pin 41 and the hinge arm 40. The hinge mechanism used in this embodiment is designed to allow the hinged lid 42 to adjustably slide up and down to accommodate different cigar 6 diameters. The ability to slide up and down in the lid slot 34 allows the hinged lid 42 to rest flat against the side surface of the cigar 6.

Figure 18:
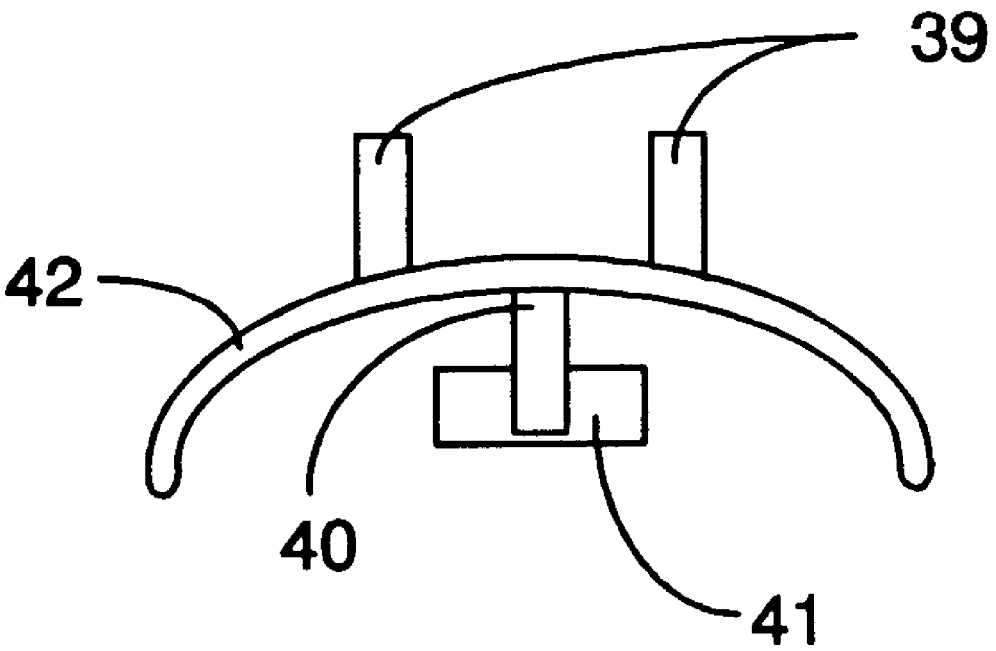
FIG. 18 is an end view of the hinged lid used in the embodiment of FIG. 13. This view shows the handle.

FIG. 18 is an end view of the hinged lid 42 used in the embodiment of FIG. 13. This view shows the handles 39, the hinge pin 41 and the hinge arm 40. Those skilled in the art will recognize that variations in the hinge structure can be made while still allowing the hinged lid 42 to move up and down to accommodate various cigar 6 sizes. In addition, the side grooves 13 of previous embodiments can also be used in combination with the punch 4 to retain the lid 42 in place when the device is being stored.

Figure 19:
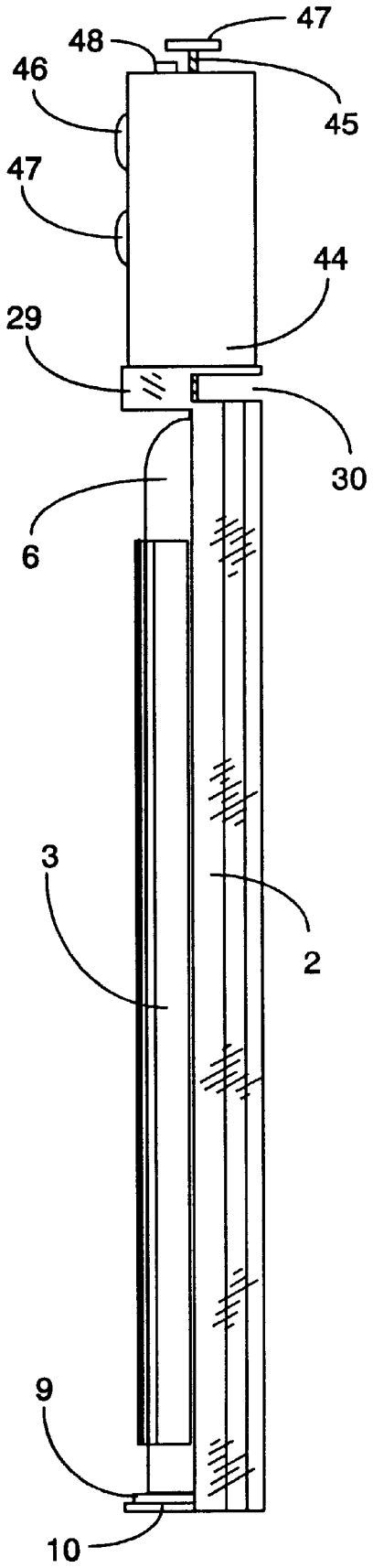
FIG. 19 illustrates a side view of an alternative embodiment that uses a threaded punch and a motorized battery operated drive.

FIG. 19 is another alternative preferred embodiment. This embodiment incorporates the features of the embodiment of FIG. 1, but includes the following new features. The handle 5 is no longer used. In its place a motorized punch controller 44 is used to drive a threaded punch 45 in and out of the cigar 6. Motorized augers are well known in the art. When forward button switch 47 is activated, the motorized punch controller 44 initiates forward motion of the threaded punch 45 into the cigar 6. When the end stop 47 closes switch 48, the motor (not shown) inside the motorized punch controller 44 is automatically stopped. When reverse button switch 47 is activated, the motorized punch controller 44 initiates reverse motion of the threaded punch 45 and withdraws the threaded punch 45 from the cigar 6. The motor in the motorized punch controller 44 can be powered in a variety of ways. In the preferred embodiment, conventional battery power is used. Likewise, while the auger-like threaded punch 45 is preferred, the threaded punch 45 or a smooth punch 4 can be driven by alternative methods such as a friction drive, etc.

While the invention has been described with respect to a preferred embodiment thereof, it will be understood by those skilled in the art that various changes in detail may be made therein without departing from the spirit, scope, and teaching of the invention. For example, the material used to construct the device may be anything suitable for its purpose, the size and shape of the device can vary. The device can be powered or unpowered. Accordingly, the invention herein disclosed is to be limited only as specified in the following claims.

We claim:

1. An apparatus for opening draw blockages in cigars, comprising:

a single punch having a sufficient length to penetrate substantially the entire longitudinal length of a cigar;

a cigar cradle having distal and proximal ends;

punch alignment means located at the proximal end of the cigar cradle and sized to allow the punch to move through the punch alignment means such that the punch is substantially longitudinally aligned with the cigar cradle;

the punch alignment means further comprises a plurality of punch alignment apertures, the punch alignment apertures sized to allow the punch to move through the punch alignment means while remaining in substantial longitudinal alignment with the cigar cradle; and the punch alignment apertures further arranged such that a plurality of substantially parallel planes are available for the punch to be inserted through the punch alignment means and the punch can be inserted through the punch alignment means at multiple locations such that multiple air passages can be created in a single cigar;

whereby, the punch can penetrate a cigar longitudinally to open a draw blockage in the cigar.

2. An apparatus, as in claim 1, further comprising a lid, the lid having a size suitable to cover at least a portion of a cigar length, and further having a length suitable to fit within the cigar cradle such that when the lid is placed on top of a cigar inserted in the cigar cradle, the lid holds the cigar in place when the punch is pushed through the punch alignment means.

3. An apparatus, as in claim 2, further comprising:

a motorized punch controller attached to an end of the cigar cradle, the motorized punch controller further comprising;

a motor;

a power supply for supplying power to the motor;

punch drive means to move the punch longitudinally forward and backward under control of the motor; and forward and backward switch controls to control activation of the punch drive means;

whereby the punch is driven through and removed from a cigar under control of the motorized punch controller.

4. An apparatus, as in claim 1, further comprising:

a motorized punch controller attached to an end of the cigar cradle, the motorized punch controller further comprising:

a motor;

a power supply for supplying power to the motor;

punch drive means to move the punch longitudinally forward and backward under control of the motor; and forward and backward switch controls to control activation of the punch drive means;

whereby the punch is driven through and removed from a cigar under control of the motorized punch controller.

5. An apparatus, as in claim 1, further comprising:

the punch is threaded;

the motorized punch controller further comprises gears which mesh with the threaded punch and rotatably move the threaded punch in an auger like fashion.

6. An apparatus for opening draw blockades in cigars, comprising:

a punch having a sufficient length to penetrate substantially the entire longitudinal length of a cigar;

a cigar cradle having distal and proximal ends;

punch alignment means located at the proximal end of the cigar cradle and sized to allow the punch to move through the punch alignment means such that the punch is substantially longitudinally aligned with the cigar cradle;

the punch alignment means further comprises a plurality of punch alignment apertures, the punch alignment apertures sized to allow the punch to move through the punch alignment means while remaining in substantial longitudinal alignment with the cigar cradle;

the punch alignment apertures further arranged such that a plurality of substantially parallel planes are available for the punch to be inserted through the punch alignment means;

whereby the punch can be inserted through the punch alignment means at multiple locations such that multiple air passages can be created in a single cigar;

a lid, the lid having a size suitable to cover at least a portion of a cigar length, and further having a length suitable to fit within the cigar cradle such that when the lid is placed on top of a cigar inserted in the cigar cradle, the lid holds the cigar in place when the punch is pushed through the punch alignment means;

a slidable hinge attached to an end of the lid; and the slidable hinge attached to a hinge attachment at an end of the cigar cradle such that the lid can pivot on the slidable hinge and the slidable hinge also slides up or down;

whereby the lid can rest on cigars of varying diameters by sliding upward or downward on the hinge attachment;

whereby, the punch can penetrate a cigar longitudinally to open a draw blockage in the cigar.

7. An apparatus, as in claim 6, wherein the lid further comprises a handle;

whereby the lid can be moved by the handle.

8. An apparatus, as in claim 6, further comprising longitudinal cigar cradle grooves in the cigar cradle, the longitudinal cigar cradle grooves spaced apart from one another such that when the lid is placed in an empty cradle, the longitudinal edges of the lid rest in the longitudinal cigar cradle grooves.

9. An apparatus, as in claim 8, further comprising:

a longitudinal lid groove in the upper surface of the lid; and at least one of the alignment apertures located such that when the longitudinal edges of the lid are placed in the longitudinal cigar cradle grooves, a punch inserted through the alignment aperture will align with the longitudinal lid groove and retain the lid in the cradle.

10. An apparatus for opening draw blockages in cigars, comprising:

a punch having a sufficient length to penetrate substantially the entire longitudinal length of a cigar;

a cigar cradle having distal and proximal ends;

punch alignment means located at the proximal end of the cigar cradle and sized to allow the punch to move through the punch alignment means such that the punch is substantially longitudinally aligned with the cigar cradle;

the punch alignment means further comprises a plurality of punch alignment apertures, the punch alignment apertures sized to allow the punch to move through the punch alignment means while remaining in substantial longitudinal alignment with the cigar cradle;

the punch alignment apertures further arranged such that a plurality of substantially parallel planes are available for the punch to be inserted through the punch alignment means;

whereby the punch can be inserted through the punch alignment means at multiple locations such that multiple air passages can be created in a single cigar;

a lid, the lid having a size suitable to cover at least a portion of a cigar length, and further having a length suitable to fit within the cigar cradle such that when the lid is placed on top of a cigar inserted in the cigar cradle, the lid holds the cigar in place when the punch is pushed through the punch alignment means; and longitudinal cigar cradle grooves in the cigar cradle, the longitudinal cigar cradle grooves spaced apart from one another such that when the lid is placed in an empty cradle, the longitudinal edges of the lid rest in the longitudinal cigar cradle grooves;

whereby, the punch can penetrate a cigar longitudinally to open a draw blockage in the cigar.

11. An apparatus, as in claim 10, further comprising:

a longitudinal lid groove in the upper surface of the lid; and at least one of the alignment apertures located such that when the longitudinal edges of the lid are placed in the longitudinal cigar cradle grooves, a punch inserted through the alignment aperture will align with the longitudinal lid groove and retain the lid in the cradle.

12. An apparatus for opening draw blockages in cigars, comprising:

a punch having a sufficient length to penetrate substantially the entire longitudinal length of a cigar;

a cigar cradle having distal and proximal ends;

punch alignment means located at the proximal end of the cigar cradle and sized to allow the punch to move through the punch alignment means such that the punch is substantially longitudinally aligned with the cigar cradle;

a spring loaded lid assembly;

a bracket attached to the cigar cradle at a first end and attached to the spring loaded lid assembly at a second end; and a push button slidably attached to the spring loaded lid assembly, the push button further attached to the lid such that when the push button is pushed, the lid moves toward the cigar cradle and when the push button is released the spring loaded lid assembly pushes the lid away from the cigar cradle;

whereby the punch can penetrate a cigar longitudinally to open a draw blockage in the cigar and the lid is automatically retracted away from the cigar cradle.

13. An apparatus, as in claim 12, further comprising:

a motorized punch controller attached to an end of the cigar cradle, the motorized punch controller further comprising;

a motor;

a power supply for supplying power to the motor;

punch drive means to move the punch longitudinally forward and backward under control of the motor; and forward and backward switch controls to control activation of the punch drive means;

whereby the punch is driven through and removed from a cigar under control of the motorized punch controller.

* * * * *